United States Patent [19]

Weber et al.

[11] 4,274,924

[45] Jun. 23, 1981

[54] APPARATUS FOR COOLING AND DEDUSTING DEGASIFICATION GASES ESCAPING FROM COAL DEGASIFICATION CHAMBERS

[75] Inventors: Heinrich Weber, Recklinghausen; Horst Dungs, Herne; Franz Beckmann, Alsdorf; Hugo Schmauch, Merchweiler; Karl-Heinz Flasch, Bons, all of Fed. Rep. of Germany

[73] Assignee: Firma Carl Still GmbH & Co. KG, Fed. Rep. of Germany

[21] Appl. No.: 46,619

[22] Filed: Jun. 8, 1979

Related U.S. Application Data

[62] Division of Ser. No. 856,039, Dec. 16, 1977.

[30] Foreign Application Priority Data

Nov. 30, 1976 [DE] Fed. Rep. of Germany ..... 2654187

[51] Int. Cl.[3] ..... C10B 27/04; C10B 27/00

[52] U.S. Cl. ..... 202/255; 202/254; 202/263

[58] Field of Search ..... 201/4, 26, 29, 30, 39, 201/41, 45; 202/254, 255, 256, 257, 258, 259, 260, 261, 263; 208/39, 48 R; 55/84, 85, 89

[56] References Cited

U.S. PATENT DOCUMENTS

| | | | |
|---|---|---|---|
| 1,849,197 | 3/1932 | Miller | 201/4 X |
| 1,849,198 | 3/1932 | Miller | 201/30 X |
| 2,976,230 | 3/1961 | Emery et al. | 208/8 R |
| 4,110,168 | 8/1978 | Brice | 201/41 X |
| 4,123,331 | 10/1978 | Laufhutte | 201/41 X |

*Primary Examiner*—Tim R. Miles
*Assistant Examiner*—Roger F. Phillips
*Attorney, Agent, or Firm*—McGlew and Tuttle

[57] ABSTRACT

A method of cooling and dedusting degasification gases which escape from coal degasification chambers particularly gases which are obtained in high temperature or low temperature carbonization of bituminous and subbituminous coals and which pass from degasification chambers through risers and bends into collection mains and in the bends or in the collecting mains themselves which comprises directing crude tar having a temperature in excess of 50° C. and lower than 170° C. into the bends and collecting mains either alone or with water added which has a temperature and is of a quantity such that it completely evaporates in the collecting main. An apparatus for carrying out the method includes means for spraying either the tar or the tar plus water into the collecting main containing the degasification gases and passing the gases and the liquids from the main into a cooler to separate the gases and a liquid condensate and the tar oil from the condensate and which includes means for directing the crude tar through a separator for separating the heavy tar from a remaining portion of the tar and further directing the remaining portion through a supply tank and a centrifuge for removing solid matter therefrom.

2 Claims, 2 Drawing Figures

APPARATUS FOR COOLING AND DEDUSTING DEGASIFICATION GASES ESCAPING FROM COAL DEGASIFICATION CHAMBERS

This is a division of application Ser. No. 856,039, filed Dec. 16, 1977.

BACKGROUND OF THE INVENTION

1. Field of the Invention

This invention relates in general to degasification devices and to a new and useful method and apparatus for cooling and dedusting degasification gases which escape from coal degasification chambers.

2. Description of the Prior Art

It is well known and in many cases usual to bring the hot degasification gases in the bends into contact with circulated cooling and scavenging water having temperatures below 100° C. In such a process, the gases, while becoming saturated with steam, are cooled down from about 800° C. to about 80°–85° C. and crude tar and water are separated in the collecting main.

For this purpose, 3.5 to 7.0 $m^3$ of water per metric ton of coal are charged into the oven chambers and are sprayed in the bends or collecting mains. Among others, the quantity of spray water depends on how much water is needed for precipitating the coal dust, which is entrained into the bends particularly at the start or the carbonization and for preventing it from being carried by the gas stream into the gas treatment apparatus, and for preventing deposits in the bends and collecting mains. Water, however, as is well known, is a poor wetting agent for coal dust.

The consequence of such a cooling method is that a tar-water mixture with a high water content and tending to emulsification is obtained in the collecting mains and that both the tar and the water components are contaminated with coal dust, and large apparatus are necessary for separating the tar-water mixture and obtaining water of such purity that it can be recirculated to the collecting main without causing disturbances in operation. But the content of solid matter and water in the tar also must not exceed predetermined limits, since otherwise the tar cannot be treated and sold without problems.

It would facilitate the operation of a coking plant if the scavenging of the collecting main and cooling of gas could be effected in a manner such as not to obtain any tar-water mixture at all in the collecting main and to obtain substantially only crude tar in liquid phase.

SUMMARY OF THE INVENTION

The present invention is directed to a method and installation in which crude tar having a temperature in excess of 50° C. and lower than 170° C. is used as the cooling and scavenging agent which is injected into the bends or collecting mains and that this tar is injected alone or with added water having a temperature and in an amount such as to completely evaporate in the collecting main.

Thereby, the crude gas is cooled down to a temperature of 100° C. to 170° C., depending on the amount and temperature of the cooling and scavenging tar. This corresponds to a temperature of the obtained waterless tar of about 90° C. In general, the tar used for cooling is injected with a temperature close to the water dew point temperature of the crude gas escaping from the oven chambers. This temperature depends on the water content of the charge coal and usually amounts to the range of between 50° C. and 75° C.

Preferred is a mode of operation in which, at the end of the collecting main, the cooled crude gas has a temperature between 120° C. and 150° C. and the tar a temperature substantially between 110° C. and 140° C.

From the collecting main, the injected cooling and scavenging tar is drained, free from water, along with the tar condensed from the gas. In any case, in this stage, still no condensation of water takes place.

The quantity of tar to be injected amounts to 0.3–8 $m^3$ per metric ton of dry charge coal. Prior art cooling and scavenging methods with water alone require an amount of water within such a range. The reason why the injection of tar instrad of water is advantageous is that the coal dust contained in the crude gas can be better wetted with tar and tar oils than with water and, consequently, the bends and collecting mains can easily be scavenged clean and prevented from clogging. The amount of tar to be injected, however, depends, within the indicated wide range, on the capability of the dust of being wetted and on its amount. Either if these values can hardly be predetermined. The tar injection is of particular importance if predried or preheated coal is charged into the degasification chambers since in such a case, the proportion of coal dust entrained by the crude gas into the collecting main is very high, especially during the charging operation.

It is also advantageous to obtain the main quantity of tar, namely 90–95% free from water.

It remains, in the inventive method, to separate the light tar obtained during the final cooling from the aqueous condensate originating, entirely or partly, in the moisture content of the charge coal and in the coking process itself (constitutional water). If also cooling water is injected in addition to the crude tar, larger quantities of water are obtained, of course, which are to be separated from the light tar. On the whole, however, the size of the separators is substantially reduced.

A determining factor for the heat transfer from the hot gas to the cooling tar is the length of the period of contact between the two media, which is taken into account in the design of the injection means, for example, by providing, instead of a single injection nozzle, a plurality, in particular 2 to 6, of further nozzles on the way to the collecting main, for example, at the top of the bend, or in the collecting main itself. Important in this connection, of course, are also the dimensions of the collecting main, i.e. the gas velocity or the period of dwell.

From the collecting main, the cooling and scavenging tar passes along with the tar condensed from the crude gas, into a heavy-tar box for separating thickened components, and then into a supply tank wherefrom the greatest part is cooled and pumped back to the collecting main as cooling and scavenging tar. In order not to exceed a certain dust content in the tar and to avoid disturbances in operation, the circulated tar is freed from solid matter, in a well-known manner, by filtration or centrifuging, and the separated solid matter is added to the charge coal. The tar in excess is drained from the supply tank as waterless tar. The crude gas cooled in the collecting main is further cooled down to about 20°–40° C. in the same manner as known in the prior art. for example in indirect cross tube coolers, and the condensate, composed of light tar and water, is directed to a small tar separator where the mixture is easily and smoothly separated into a tarry and an aqueous phase.

The separated light tar containing about 1–2% of water is drained as a product for sale or again pumped into the collecting main as cooling and scavenging agent.

The particular advantage resulting from the inventive method is in any case the fact that the water-tar separation is effected in relatively small apparatus and that the main quantity of tar is obtained without any water content.

If, in accordance with the invention, water is injected into the hot crude gas in addition to tar, the water amount is to be metered so as to completely evaporate, and the added tar serves only as a scavenging agent. According to a particular variant of the method, the amount of injected water may be controlled as a function of the gas temperature at which the gas leaves the collecting main. In this way, the keeping of a crude gas temperature above the water dew point is particularly simple.

In such a case, the amounts are preferably adjusted so as to obtain in the collecting main a temperature of the cooled crude gas of 120° C. to 150° C. In this variant of the method again, the scavenging and condensate tar passes, free from water, through the heavy tar box into the supply tank wherefrom the tar in excess is removed also free from water. The gas is subjected only to a final cooling during which it cools down, as mentioned above, to 20°–40° C. The obtained light tar, of course, as also mentioned above, is to be separated from somewhat larger amounts of water. Otherwise, the treatment follows the well-known cooling methods. Substantially smaller separators are needed, as compared to the conventional gas cooling apparatus.

The inventive method proves particularly advantageous if coal briquets or other forms are coked which are made with crude tar, for example, from coals with poorer coking properties; for example as set forth in German Patent Applications P 2555431.8 and 2640787.4 In this case, it is true, the tar which has been added to the coal mixtures is partly decomposed and cracked, but the amount of tar obtained is thereby notably increased. This increase is to be taken into account while designing known tar separation equipment and correspondingly larger separators are to be provided. Since in the inventive method, the crude tar is obtained free from water, no larger water-tar separation volume is needed.

For keeping the spray water for the risers clean, it has already been provided, in the prior art, to inject tar, free from solid matter, during the period of charging coal into the oven chambers and during the initial period of carbonization, and to inject water during the remaining period of time (German Patent Application P 2600130.9). With such a provision, however, the advantages of the present invention could not be obtained, since in this design of the prior art, among others, no simplification of the apparatus is possible and no waterless tar is obtained.

Accordingly it is an object of the invention to provide a method of cooling and dedusting degasification gases escaping from coal degasification chambers such as coke ovens which comprises directing a crude tar having a temperature in excess of 50° C. but lower than 170° C. into a collecting main or collecting area for the gases either alone or with the addition of water having a temperature and an amount such as to completely evaporate in the collecting main.

A further object of the invention is to provide a method of cooling and dedusting degasification gases which comprises directing the gases into a collecting main, adding a crude tar of around 3 to 6 cubic meters per ton at a temperature of 70° with a water content of less than 1% to the gases so as to cool the gases to around 150° C. and to heat the tar up to about 140° C., permitting the gases and liquids to separate and directing the gases to a cooler to cool them down to around 30° C. and to condense liquid in the cooler which is directed into a separator for removing tar oils from the water, further directing the crude tar oil after it is separated from the gas into a separator prior to its being recirculated into the collecting main.

A further object of the invention is to provide an apparatus for carrying out the method of the invention which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
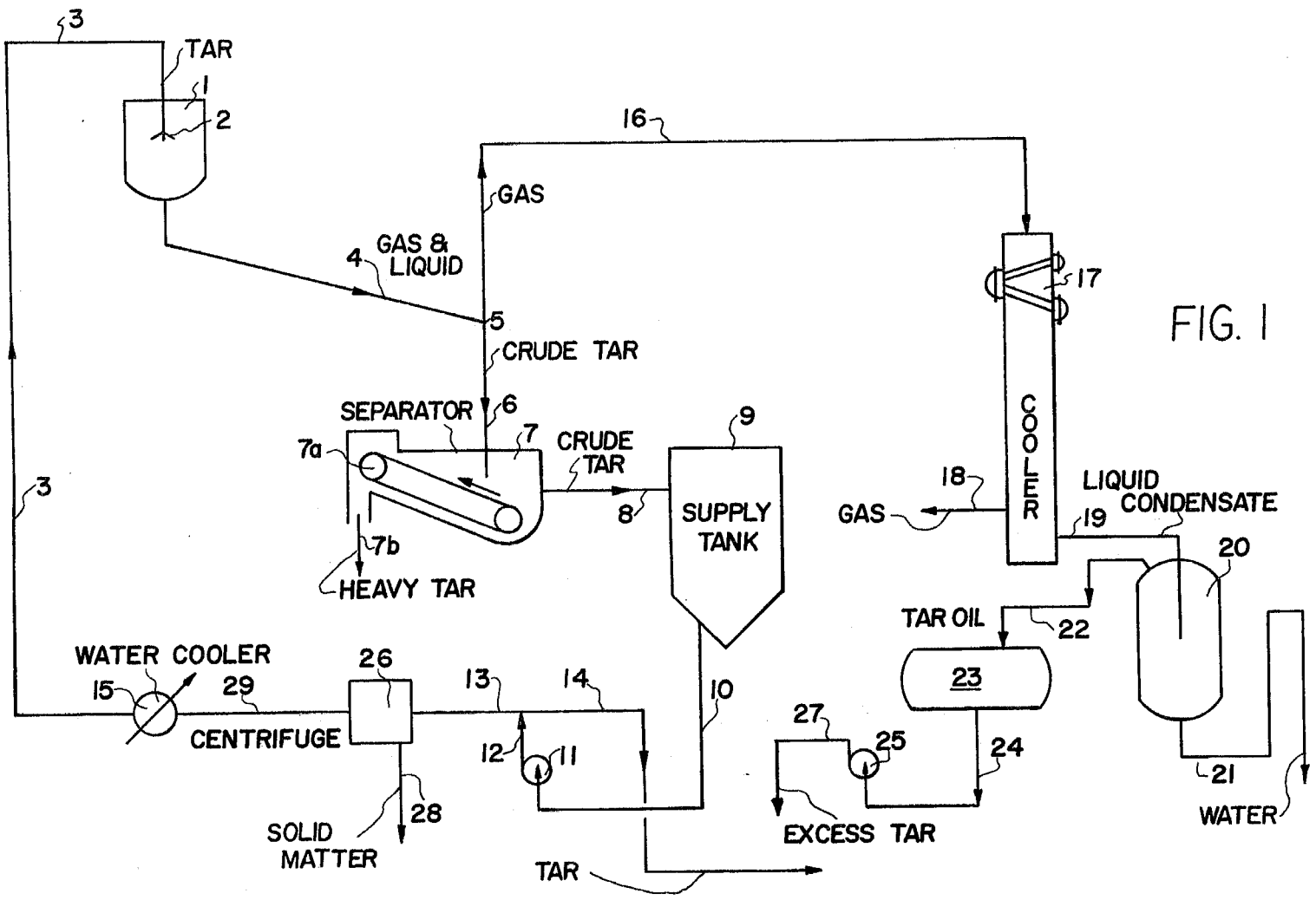
FIG. 1 is a schematic drawing of an apparatus for cooling and dedusting degasification gases escaping from coal degasification chambers constructed in accordance with the invention.

Referring to the drawings in particular, the invention embodied therein in FIG. 1 comprises an apparatus for effecting the cooling and dedusting of degasification gases which escape from coal degasification chambers particularly in the high temperature or low temperature carbonization of bituminous and subbituminous coals which are collecting in a collecting main 1.

From 244 metric tons of coal having a water content of 9.84%, 75,000 $Nm^3$ per hour of coke oven gas and 32,000 kgs per hour of steam are obtained. The gas mixture has a water dew point at 73° C. and passes into a collecting main 1 through riser bends (not shown) and at a temperature of 800° C. Through spray nozzles 2 provided at the ends of pipes 3, 4.5 $m^3$ per metric ton of charge coal of crude tar having a temperature of 70° C. and a water content of less than 1% are sprayed into collecting main 1, whereby the distillation gas is cooled down to 150° C. and the crude tar sprayed in is heated up to 140° C. Gas and liquid are removed from collecting main 1 through a line 4. At 5, gas and liquid separate from each other. The gas, having still a temperature of about 150° C., passes through a line 16 into a cross tube cooler 17 in which $23.2\times10^6$ kcal/h are absorbed and wherefrom the gas, cooled down to 30° C., is directed through a line 18 to further treatment.

The liquid condensates from cross tube cooler 17, i.e. 400 kgs of light tar and 30,160 kgs of water per hour, having a temperature of 30° C., are drained through a line 19 and separated, in a separator 20, into tar oils and water. The water is removed through a line 21 while the tar oils floating on the water are removed through a line 22, collected in a tank 23, and drained through a line 24 by means of a pump 25. Tar oils in excess in the amount of 400 kgs per hour and with a water content of 2% pass through a line 27 out of the plant, for further treatment.

The crude tar from collecting main 1 has a temperature of about 140° C. and passes through a line 6 into a heavy-tar separator 7 comprising a discharge mechanism *7a*, and to the heavy tar outlet *7b*. Through a line 8, the crude tar is directed to a supply tank 9. Tar to be circulated through collecting main 1 is removed by a pump 11 through a line 10. About 1,000 $m^3$ per hour of circulating tar having a temperature of 140° C. are delivered through a line 12, and pass through a line 13, to a centrifuge 26 where the solid matter is separated from the tar. The solid matter is removed through a line 28 and added to the charge coal. The tar free from solid matter further passes through a line 29 into a water cooler 15 in which $30\times10^6$ kcal per hour are absorbed. Thereupon, the crude tar cooled down to 70° C. is recycled, through line 3, to the collecting main 1. Thereby, the tar circuit is closed. The produced non-circulated tar in the amount of 7,250 kgs is removed through a line 14.

Figure 2:
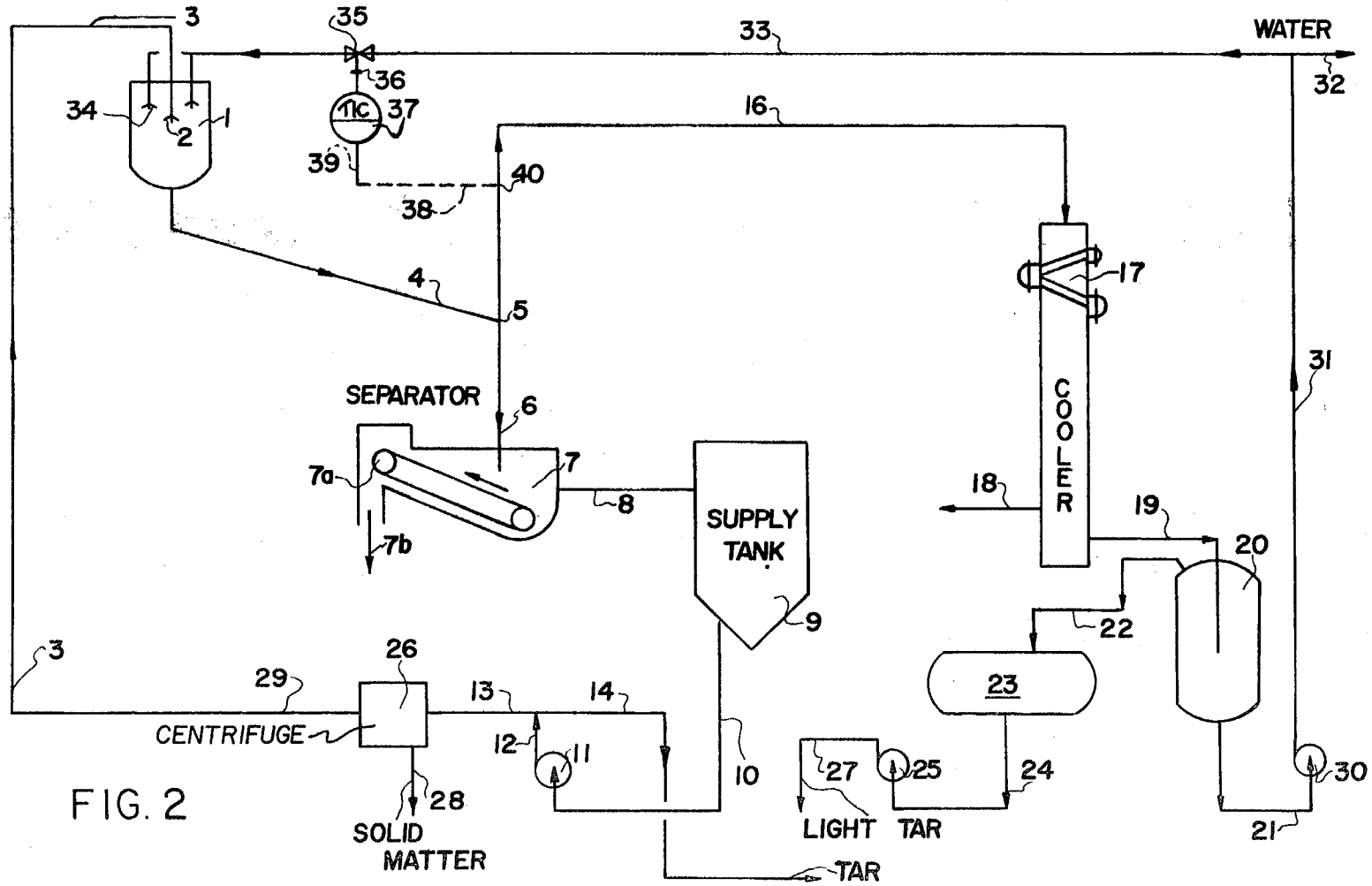
FIG. 2 is a view similar to FIG. 1 of another embodiment of the invention.

In the embodiment shown in FIG. 2 the apparatus is similar to that shown in FIG. 1 but in this design the cooler 15 is omitted and the tar circulated in a plant at a temperature of 150° C. Thus, the tar serves only as a scavenging agent. Line 21 conveys the water separated from tar oil to a pump 30 by which it is delivered to a line 31. Water in the amount of 30,160 kgs per hour is discharged from the plant through a line 32, and 47,370 kgs per hour of water are directed through a line 33 to collecting main 1 where they are distributed through spray nozzles 34.

From the collecting main, gas and liquids having a temperature of 150° C. pass into cross tube cooler 17 where $54.6\times10^6$ kcal/h are absorbed. The amount of water is metered so as to obtain an aqueous condensate not in the collecting main, but only as far as in the cross tube cooler. That is why there is no need for designing supply tank 9 as a large separating tank, and the separation of tar oil and water in the lower part of cross tube cooler 17 takes place in a simple and smooth manner, due to the low solubility of tar oils in water and, inversely, of water in tar oils, and to the low viscosity of the two liquids as well as to their relatively low dust content. The parts designated 35 to 40 constitute a temperature-quantity control.

In the embodiment shown in FIG. 2 the charge comprising, for example, briquets in the amount of 232 metric tons per hour, made of predried, preheated bituminous coal having medium coking properties, and of 12 metric tons of crude tar. Since cooler 15 is omitted, the tar circulates in the plant with a temperature of 150° C. Through line 33 and nozzles 34, 40, 351 kgs per hour of water having a temperature of 30° C. are injected into collecting main 1. Along with 75,000 $Nm^3$ of coke oven gas having a temperature of 150° C. 49,151 kgs per hour of steam leave collecting main 1, and the gas-steam mixture has a water dew point at 78.9° C. Cross tube cooler 17 absorbs $34\times10^6$ kcal, and through line 32, 6,160 kgs per hour of water are discharged from the plant. Through line 27, 720 kgs of light tar and through line 14, 12,000 kgs of tar are removed per hour. The solid matter separated in centrifuge 26 is delivered, through line 28, to the briquetting plant where it is used as added material for the briquet production.

While specific embodiments of the invention have been shown and described in detail to illustrate the application of the principles of the invention, it will be understood that the invention may be embodied otherwise without departing from such principles.

What is claimed is:

1. An apparatus for cooling and dedusting degasification gases which escape from coal degasification chambers comprising a collecting main, means for circulating a crude tar into the collecting main and into the gases therein to dedust the gases and thereby forming dedusted gases and liquid, means for metering water into said collecting main in addition to crude tar, conduit means connected to said collecting main for separating the dedusted gases and liquid, first separator means connected to said collecting main for receiving the liquid from said dedusted gases and for separating heavy tar and crude tar in the liquid, recirculating means connected to said first separator means for recirculating the separated crude tar back to said collecting main, a cooler for condensing part of the gases to form a condensate, a conduit for gases connected to said conduit means for passing the dedusted gases to said cooler, and temperature control means operatively connected to said metering means, operatively responsive to the temperature in said conduit for gases, for operating said metering means to inject an amount of said water into the collecting main relative to the degasification gases so as to completely evaporate the water in the collecting main.

2. A device according to claim 1, further comprising second separator means connected to said cooler for separating tar oils from water in the condensate, and means for recirculating the water from the second separator means back to said collecting main.

* * * * *